United States Patent [19]

Greenwood

[11] Patent Number: 4,480,162

[45] Date of Patent: Oct. 30, 1984

[54] ELECTRICAL SWITCH DEVICE WITH AN INTEGRAL SEMICONDUCTOR CONTACT ELEMENT

[75] Inventor: John C. Greenwood, Harlow, England

[73] Assignee: International Standard Electric Corporation, New York, N.Y.

[21] Appl. No.: 352,410

[22] Filed: Feb. 26, 1982

[30] Foreign Application Priority Data

Mar. 17, 1981 [GB] United Kingdom ..... 8108280

[51] Int. Cl.[3] ..... H01H 57/00; H01H 3/02

[52] U.S. Cl. ..... 200/181; 200/340

[58] Field of Search ..... 200/181, 244, 283, 340; 179/90 K

[56] References Cited

U.S. PATENT DOCUMENTS

| | | | |
|---|---|---|---|
| 3,509,470 | 4/1970 | Droppa et al. | 200/181 |
| 3,777,093 | 12/1973 | Sterns et al. | 200/181 |
| 4,112,279 | 9/1978 | Brohard | 200/181 |
| 4,351,988 | 9/1982 | Allbright | 200/329 X |

FOREIGN PATENT DOCUMENTS

| | | | |
|---|---|---|---|
| 1584914 | 2/1981 | United Kingdom | 200/181 |

OTHER PUBLICATIONS

Peterson, *Micromechanical Membrane Switches on Silicon*, Jul. 1979, pp. 376–382.

*Primary Examiner*—John W. Shepperd
*Assistant Examiner*—Renee S. Kidorf
*Attorney, Agent, or Firm*—James B. Raden; William J. Michals

[57] ABSTRACT

An electrical contact element includes a support component of an effectively electrically insulating material, especially silicon, the support component including a supporting body and an armature integral with and hingedly connected to the supporting body, the armature carrying at least one electrical contact. The electrical contact element is accommodated in a housing which is hermetically sealed and either filled with an inert gas or evacuated. The housing includes at least one fixed contact, and the supporting body is shaped as a frame which has a recess in which the armature is received when electrical contact is established between the electrical contact carried by the armature and the fixed electrical contacts carried by the housing. The electrical contact element is made by material-removing techniques from a single substantially plate-shaped member and then the electrical contact is vapor-deposited thereon.

3 Claims, 4 Drawing Figures

ELECTRICAL SWITCH DEVICE WITH AN INTEGRAL SEMICONDUCTOR CONTACT ELEMENT

BACKGROUND OF THE INVENTION

The present invention relates to relays and switches generally, and in particular to a switch device fabricated from a resilient, effectively electrically insulating body and to methods of fabricating such devices.

Electrically operated relays are widely used in a variety of switching applications. Typically such relays are of the electromagnetic type in which one or more contacts are actuated via a solenoid and armature arrangement. While such an arrangement is extremely reliable, its multipart construction results in relatively high manufacturing costs and the necessary solenoid current leads to power dissipation. Furthermore, as it is difficult to manufacture very small solenoids, a high packing density of such relays, for example in telephone switching application, cannot be achieved. Attempts to overcome this problem have resulted in the introduction of the reed contact switch which, while going some way to reducing size and manufacturing costs, still suffers from the disadvantage of power dissipation.

SUMMARY OF THE INVENTION

Accordingly, it is a general object of the present invention to avoid the disadvantages of the prior art.

More particularly, it is an object of the present invention to provide an electrical contact element which is not possessed of the disadvantages of the conventional electrical contact elements.

A further object of the present invention is to develop an electrical contact unit which is relatively small and does not suffer of excessive electric power dissipation.

A concomitant object of the present invention is so to construct the electrical contact unit as to be simple in construction, inexpensive to manufacture, and reliable in operation nevertheless.

Still another object of the invention is to devise a method of producing the electrical contact element which is suited for low-cost manufacture.

One form of a contact unit suitable for use in the present invention is described in our British Pat. No. 1,584,914. This contact unit comprises a switching relay device in which the switching action of the device is produced by movement of one or more thin and flexible strip-like members of silicon, in which the strip-like member or each of the strip-like members is secured at both of its ends, and in which the application of a non-mechanical controlling influence to the strip-like member or members produces movement thereof to cause the operation of electrical contacts.

We have now found that contact operation may be achieved by electrostatically induced movement of a hinged body of an effectively electrically insulating resilient material.

There is provided an electrical contact element, comprising a support component of an effectively electrically insulating material, including a supporting body, and an armature integral with and hingedly connected to the supporting body; and at least one electrical contact disposed on the armature. The electrical contact element may further comprise restraining means integral with the support component and operative for restraining displacement of the armature relative to the supporting body. Advantageously, the effectively electrically insulating material is silicon, preferably boron doped silicon, and the electrical contact is of a gold-containing material, such as gold or a gold alloy.

According to another aspect of the invention, there is provided a method of making an electrical contact element, comprising the steps of removing material from a substantially plate-shaped body of an effectively electrically insulating material so as to form an armature integral with and hinged to the body; and depositing at least one electrical contact on the armature.

According to a further aspect of the invention there is provided an electrical contact unit, comprising a housing; fixed electrical contacts disposed in the housing; a contact element of an effectively electrically insulating material mounted in the housing and including a supporting body, and an armature integral with and hingedly connected to the supporting body; at least one electrical contact disposed on the armature for displacement therewith into and out of contact with the fixed contacts; and means for displacing the armature relative to the supporting body under the influence of electrostatic forces to engage and disengage the movable and fixed contacts. The contact element advantageously further includes integral spring means for restraining the displacement of the armature relative to the supporting body. It is further advantageous when the effectively electrically insulating material is silicon, especially boron doped silicon. It is especially advantageous when means for hermetically sealing the housing is provided, and when the interior of the housing is filled with an inert gas or is evacuated.

By forming the contact element from e.g. a semiconductor body by controlled etching techniques, a very small device can be obtained. With such small dimensions, electrostatic forces are sufficient to operate the contact unit without the necessity to employ relatively high voltages. Furthermore, as the contact element is small and does not require an operating solenoid, a high packing density of such contact units can be achieved e.g. in the construction of a telecommunication exchange.

BRIEF DESCRIPTION OF THE DRAWING

Above-mentioned and other features and objects of this invention will become more apparent by reference to the following description taken in conjunction with the accompanying drawing, in which.

DETAILED DESCRIPTION OF THE PREFERRED EMBODIMENTS

Figure 1:
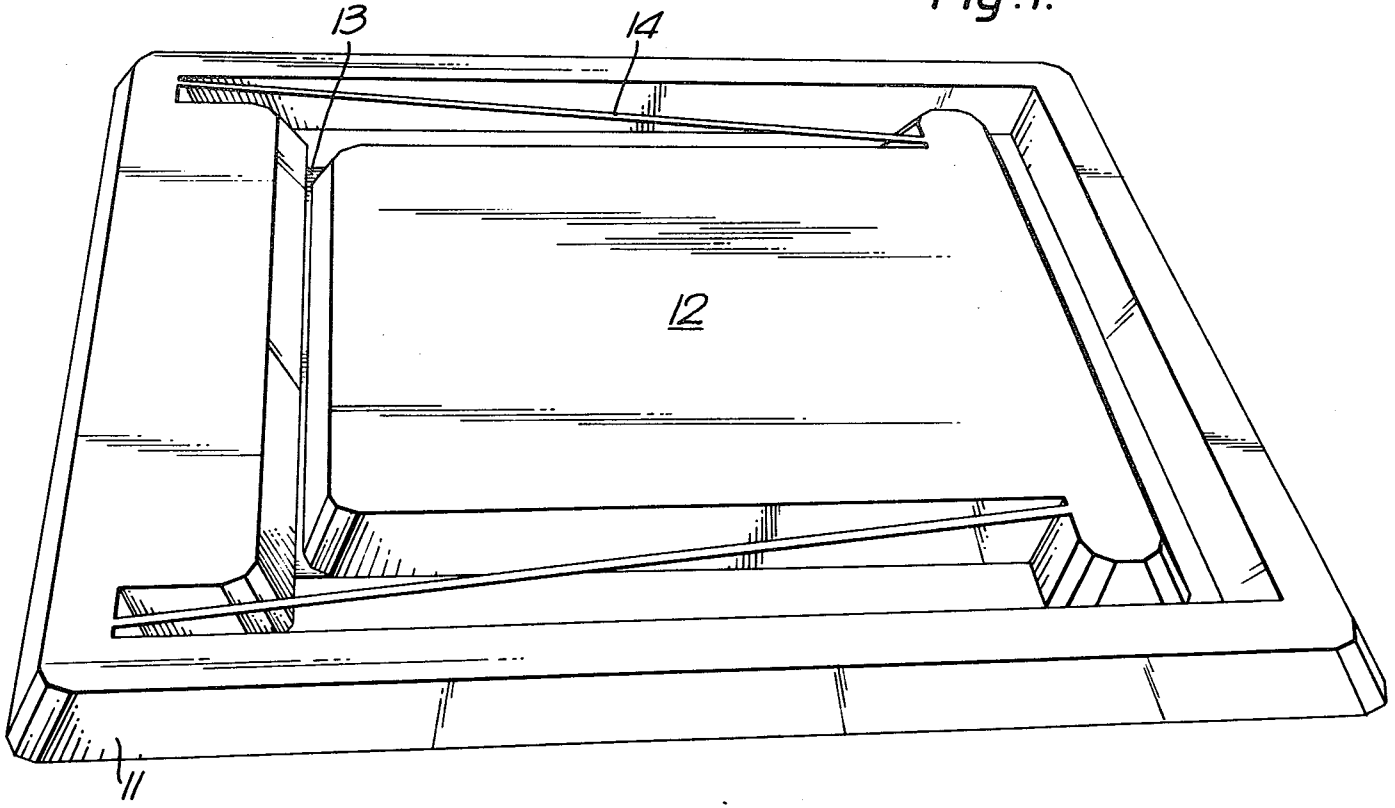
FIG. 1 is a perspective view of the electrical contact element of the invention.

Referring to FIG. 1, the contact element is formed from a body of a resilient effectively insulating material, typically silicon, and comprises a substantially rectangular frame 11 in which an armature 12 is supported by a thin flexible hinge 13 of the resilient material. The frame 11, the armature 12 and the hinge 13 are integral with one another. The rest position of the armature 12 is defined by springs 14 each of which comprises a thin filament of the resilient material. The springs 14 are also integral with the frame 11 and the armature 12.

The contact unit of FIG. 1 can be formed from a variety of materials which are both resilient and effectively electrically insulating. Fabrication may be effected e.g. by laser machining or, where the material is crystalline, by a selective etching technique.

We prefer to employ silicon as the contact unit material. We have found that, although silicon is not strictly an insulator but is a semiconductor, in practice its resistivity is sufficiently high to provide effective isolation of switch contacts disposed thereon.

Silicon is normally regarded as an electronic material but it also offers extraordinarily good mechanical properties. This combination of its intrinsic properties and the availability of large single crystals of high perfection, at moderate cost, makes it particularly suitable for the present application. It obeys Hooke's linear stress/-strain law almost perfectly up to fracture point, plastic flow being essentially absent at moderate stresses. Silicon offers stiffness and strength comparable with steel and is highly stable both thermally and chemically.

The original work on the chemical shaping of silicon, and in particular the inhibition of etching by boron doping, has been developed to the point at which the capability now exists to make very complicated structures with high precision and repeatability. The shaping process consists of chemical etches which are highly preferential on certain crystal planes and are also sensitive to doping levels. With prior knowledge of the different etch rates along different axes, masking can be done by photolithography, so that the desired shape is obtained. Doping, a process well controlled in conventional silicon technology, permits selected volumes to be protected from the etching process—the etch rate of silicon is reduced virtually to zero when the boron concentration is about $4\times10^{19}$ atoms per $cm^2$. Struts and membranes can in this way be readily made to thicknesses down to a few microns.

The contact element of FIG. 1 may be formed e.g. from a silicon body by a selective etching technique. Typically the silicon is selectively doped with boron to a level of at least $4\times10^{19}$ atoms/$cm^2$ in those regions that will ultimately comprise the contact unit. The wafer is then etched e.g. with a mixture of catechol, ethylene diamine and water or a mixture of potassium hydroxide, isoppropyl alcohol and water. Such etch compositions have been found to be chemically selective when employed with boron doped silicon. There is an abrupt change in etch rate from that normal for undoped silicon to substantially zero at a boron doped interface so that the configuration of unetched regions is defined precisely by their boron doping profiles. Typically a single crystal silicon body is doped with boron through a mask in those areas where etching is not required and is then subjected to the etching treatment to remove only the undoped material. Such techniques are more fully described in our published specification No. 1,211,496 (J. G. Greenwood 6).

Although only a single contact element is shown in FIG. 1 it will be clear to those skilled in the art that a plurality of such contact elements may be fabricated simultaneously e.g. on a single semiconductor wafer, the wafer subsequently being subdivided by conventional techniques to form the individual contact elements.

Figure 2:
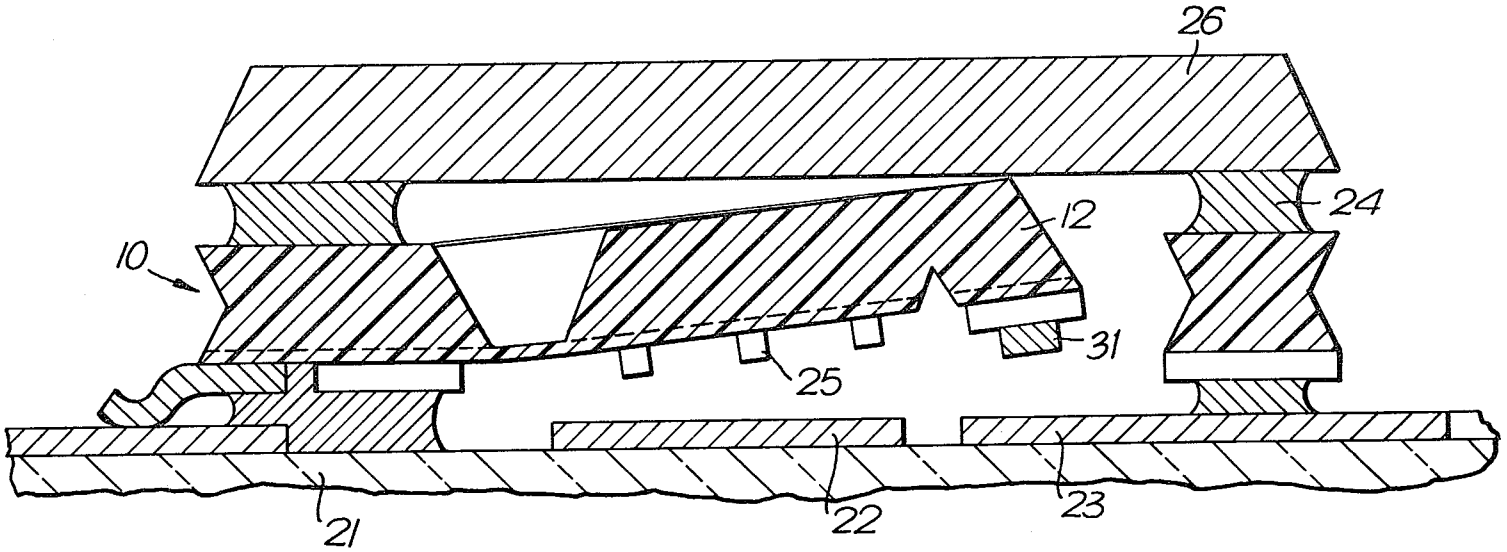
FIG. 2 is a cross-sectional view of a contact unit incorporating the contact element of FIG. 1.

Referring now to FIG. 2, in which it should be noted that some of the dimensions have been exaggerated for clarity, it can be seen that the electrostatic contact unit shown in cross-section consists of three layers. The arrangement includes an insulating substrate 21, e.g. of glass, on which the fixed electrodes 22 and fixed contacts 23 are formed. The middle layer comprises the contact element 10 of FIG. 1. The top layer is a lid 26 which also acts as a stop for the armature 12 in its open position. The cavity 24 defined by the arrangement, which is made of insulator and the resilient material optionally hermetically bonded, may be evacuated or filled with an inert gas so that the electric fields necessary to obtain the required closing force can be applied without the risk of electrical breakdown. A vacuum also provides a contamination free environment for the contacts 23 and 31.

To prevent sag of the central part of the armature during operation one or more insulating limit stops 25 may be provided on the substrate 21 or on the armature 12.

Figure 3:
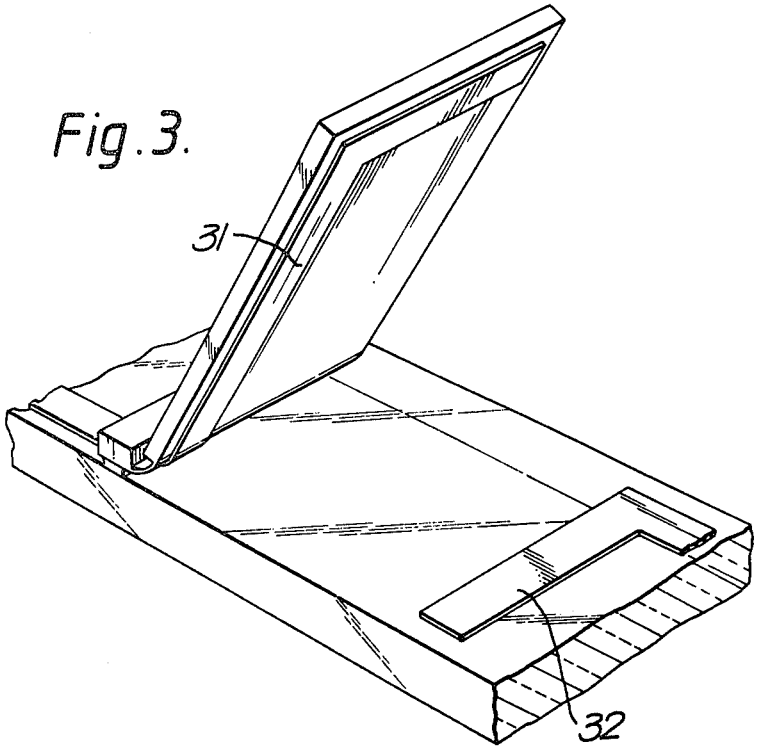
FIGS. 3 and 4 show alternative contact arrangements.
Figure 4:
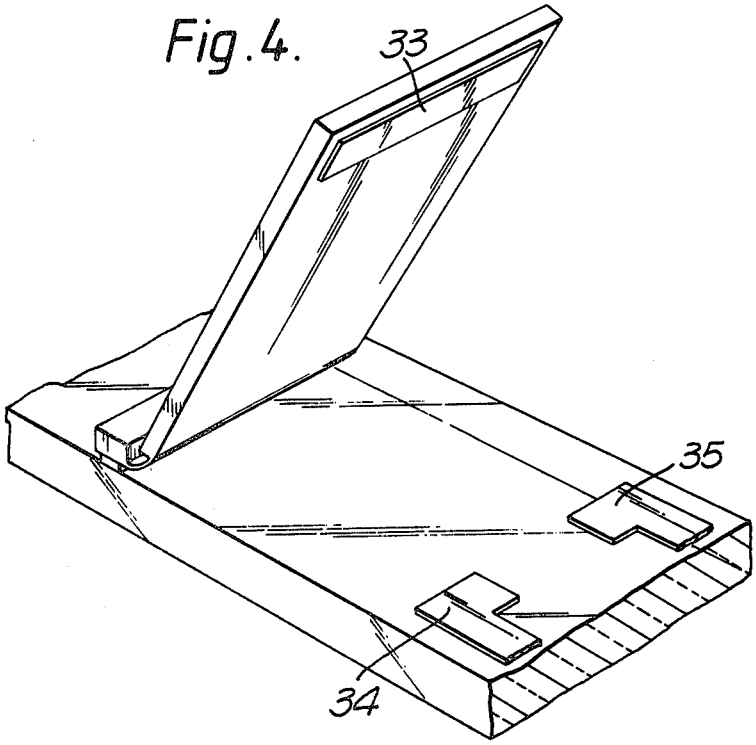

FIGS. 3 and 4 show two alternative forms of contact arrangements. In the arrangement of FIG. 3 a single L-shaped conductive track 31 is formed on the armature, this metal track extending across the hinge to an external connection (not shown). When the armature is in its closed position, the track 31 abuts a fixed conductor track 32 disposed on the base of the relay housing to effect contact.

The alternative arrangement of FIG. 4 does not require an electrical connection to the armature contact. In this arrangement, the armature comprises a conductive strip or movable contact 33 carried at the free end of the armature. With the armature in its closed position, the contact 33 bridges a pair of fixed contacts 34 and 35 to establish connection.

Advantageously the movable and fixed contacts are formed from evaporated gold or a gold alloy.

While we have described above the principles of our invention in connection with specific apparatus it is to be clearly understood that this description is made only by way of example and not as a limitation to the scope of our invention as set forth in the objects thereof and in the accompanying claims.

We claim:

1. An electrical contact element, comprising a support component of an effectively electrically insulating material, including a supporting body, and an armature integral with and hingedly connected to said supporting body;

restraining means integral with said support component and operative for restraining displacement of said armature relative to said supporting body; and at least one electrical contact disposed on said armature.

2. An electrical contact element, comprising a support component of silicon material, including a substantially plate-shaped supporting body bounding a recess, an armature, a flexible hinging portion integral with said supporting body and with said armature and connecting said armature to said supporting body for displacement between a first position in which said armature is received in said recess and a second position in which said armature at least partially extends out of said recess, and at least one filamentary spring integral with said armature and with said supporting body and operative for restraining the displacement of said armature relative to said supporting body; and at least one electrical contact region disposed on said armature.

3. An electrical contact unit, comprising a housing;

fixed electrical contacts disposed in said housing;

a contact element of an effectively electrically insulating material mounted in said housing and including a supporting body, an armature integral with and hingedly connected to said supporting body, and restraining means integral with said supporting body and said armature and operative for restraining the displacement of said armature relative to said supporting body;

at least one electrical contact disposed on said armature for displacement therewith into and out of contact with said fixed contacts; and means for displacing said armature relative to said supporting body under the influence of electrostatic forces to engage and disengage said movable and fixed contacts.

* * * * *